US005362133A

United States Patent [19]

Geuns

[11] Patent Number: 5,362,133

[45] Date of Patent: Nov. 8, 1994

[54] METHOD OF MINING COAL SEAMS AT A DEFINED PRESET DEPTH OF CUTTING DURING PLOUGHING WITH A CUTTER

[75] Inventor: Guy Geuns, Wuppertal, Germany

[73] Assignee: Hermann Hemscheidt Maschinenfabrik GmbH & Co., Wuppertal, Germany

[21] Appl. No.: 37,839

[22] Filed: Mar. 29, 1993

[30] Foreign Application Priority Data

Apr. 4, 1992 [DE] Germany ..... 4211340

[51] Int. Cl.[5] ..... E21C 35/14; E21D 23/14

[52] U.S. Cl. ..... 299/1.7; 405/302

[58] Field of Search ..... 299/1.6, 1.7, 32, 19; 405/302

[56] References Cited

U.S. PATENT DOCUMENTS 3,531,159 9/1970 Schmidt ..... 299/1.7
5,137,336 8/1992 Merten ..... 405/302 X
5,275,469 1/1994 Geuns et al. ..... 299/1.7

*Primary Examiner*—David J. Bagnell
*Attorney, Agent, or Firm*—Keck, Mahin & Cate

[57] ABSTRACT

In a method of mining coal seams using a ploughing cutter, a longwall conveyor extending along the coal face is moved forwards by the extension of self-advancing cylinders, the advance being controlled in dependence on a piston stroke of a respective self-advancing cylinder and being made in individual defined partial strokes using travel-measuring signals generated at each partial stroke. The distance covered by the partial strokes corresponds to the preset depth of cutting and is increased by an amount sufficient to compensate an average mechanical clearance at the pivot points of the self-advancing cylinders. In addition, a defined face line is fixed with respect to a center of rotation on the side of a main or auxiliary drive of the cutter so as to form a straight line through the center of rotation, the straight line being pivoted through an angle <90° so that a circular segment is mined.

8 Claims, 4 Drawing Sheets

METHOD OF MINING COAL SEAMS AT A DEFINED PRESET DEPTH OF CUTTING DURING PLOUGHING WITH A CUTTER

The invention relates to a method of mining coal seams at a defined preset depth of cutting, during ploughing with a cutter.

The earlier German patent application P 41 17 732.0 proposes a method of mining coal seams at a defined preset depth of cutting during coal-winning with the use of a ploughing cutter, there being a longwall conveyor which moves along a face and is advanced by a defined preset depth of cutting. The advance of the conveyor is made by the extension of self-advancing cylinders pivoted at one end to the conveyor and at the other end to roof supports disposed parallel to the conveyor, the advance being controlled in dependence on a piston stroke by the self-advancing cylinders and being carried out in individual defined partial strokes, more particularly corresponding to the preset depths of cutting, using travel-measuring signals generated at each partial stroke. After a predetermined maximum total piston stroke has been reached, the roof support connected to the respective self-advancing cylinder is automatically retracted, moved forwards by the maximum total piston stroke, and then re-set. The distance covered by the partial strokes corresponding to the preset depth of cutting is increased by an amount sufficient to compensate an average mechanical clearance at the pivot points of the self-advancing cylinders. This process prevents the conveyor from sloping during the entire mining operation, and mining always occurs at a defined depth of cutting, irrespective of the nature of the coal in the face, while the cutter is prevented from jamming. At the end of each face, the face has to be rotated through 180° so that the next longwall can be mined in the opposite direction to the preceding longwall. At present, this rotation or pivoting of the face necessitates dismantling the roof supports and establishing the next longwall. This process is time-consuming and laborious, resulting in high labour costs and losses of output.

The aim of the present invention, based on the previously-described process, is to rotate or pivot the face automatically. To this end, according to the invention, a defined face line inside the face in the form of a final value is fixed with respect to a centre of rotation on the side of a main or auxiliary drive of the cutter so that the final value forms a straight line through the centre of rotation, the straight line being pivoted through an angle $<900°$ with respect to the respective preceding initial face line which lies on a straight line likewise passing through the centre of rotation, so that a circular segment is mined.

Advantageously, according to the invention, the individual roof supports are moved forwards, depending on their distance from the centre, in individual equal- sized partial strokes, different from one support to another, until the respective face-line final value is reached, the cutter being continuously moved along the entire face.

The advantage of this method according to the invention is that the cutter does not need any special control but is continuously in operation, so that the face can be altered, i.e. pivoted, exclusively by controlling the partial strokes of the individual roof supports.

According to another advantageous feature, the individual roof supports are advanced in constant equal partial strokes, and the distance travelled by the cutter along the face is shortened in dependence on the advance of the roof supports and the time when each reaches the face-line final value. In this variant of the invention, the cutter is actuated in dependence on the respective position of the roof supports, the distance travelled by the cutter being shortened in dependence on the time when the final value, is reached for the face line.

Other advantageous embodiments of the invention are described in the other subsidiary claims.

The invention will now be explained in detail with reference to the outlines of the process as shown in the accompanying drawings, in which.

Figure 1:
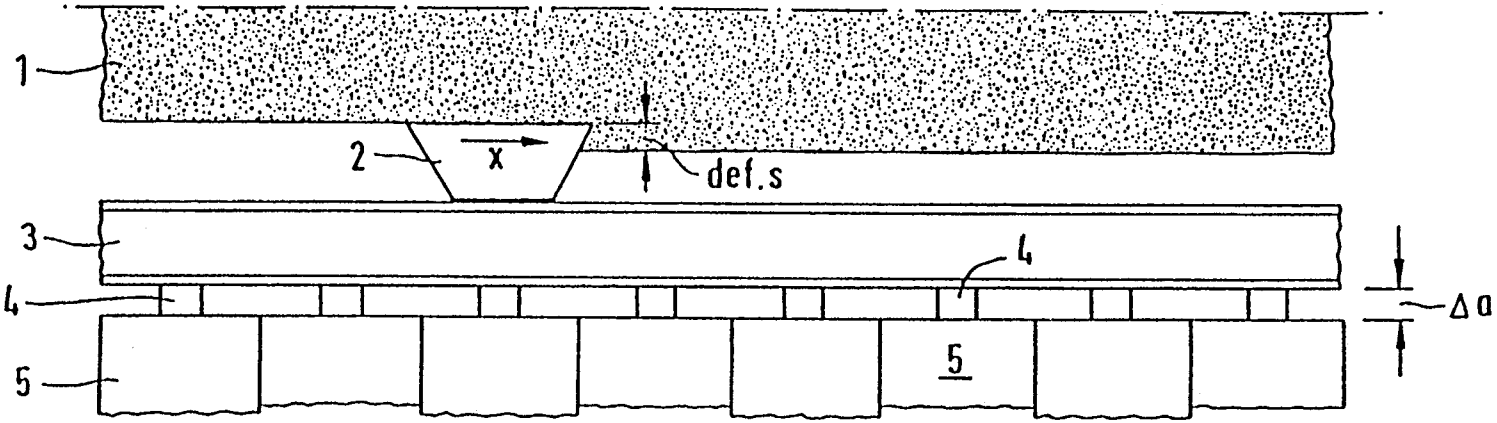
FIGS. 1 to 4 are flow charts of a method of mining coal seams with a defined preset cutting depth and compensation of clearance.

FIGS. 1 to 4 are diagrammatic sketches of the mining situation in a longwall. A cutter 2 is driven along a coal face 1, past a longwall conveyor 3 disposed parallel to the coal face 1. The longwall conveyor 3 is moved forwards by self-advancing cylinders 4 pivoted at one end to the longwall conveyor 3 and at the other end to roof supports 5 disposed parallel to the conveyor 3. The roof supports 5 can e.g. be two-prop shield-type supports, either with a rigid continuous roof bar or an adjustable sliding bar.

FIG. 1 shows phase 1 of the process in which all roof supports 5 are set and the self-advancing cylinders are in their starting position. The cutter has a cutting depth def.s, and is driven in the direction of arrow x.

Figure 2:
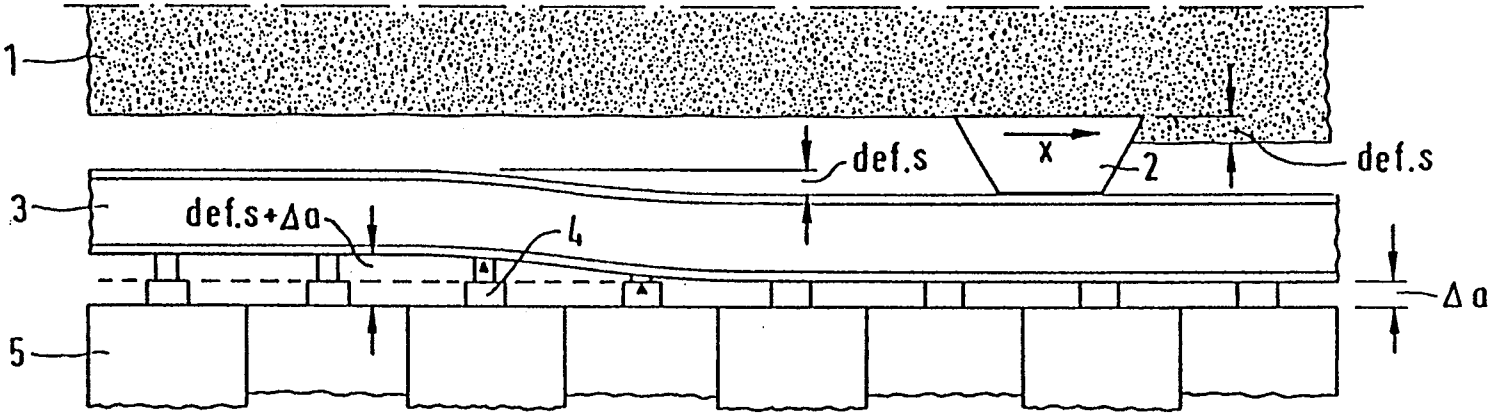

FIG. 2 shows the second phase of the process wherein the self-advancing cylinders of those roof supports which have already passed the cutter are now extended by the defined preset cutting depth def.s plus a compensating amount $\Delta a$. $\Delta a$ is the amount for compensating a mechanical clearance substantially at the pivot points of the self-advancing cylinder, the advance of the conveyor and consequently the preset depth of cutting by the cutter being less than the distance travelled corresponding to the individual partial stroke. The purpose of increasing the travel of each partial stroke by the amount $\Delta a$ corresponding to the existing mechanical clearance is to ensure that the conveyor always travels the distance def.s and consequently maintains the preset depth of cutting def.s. The extension by the amount $\Delta a$ is made before the passage of the cutter. The advance is controlled in dependence on the piston stroke of the self-advancing cylinders, carried out in defined individual partial strokes and using travel-measuring signals generated at each partial stroke, i.e. path-measuring sensors are disposed on the self-advancing cylinders and generate a signal after each partial stroke.

Figure 3:
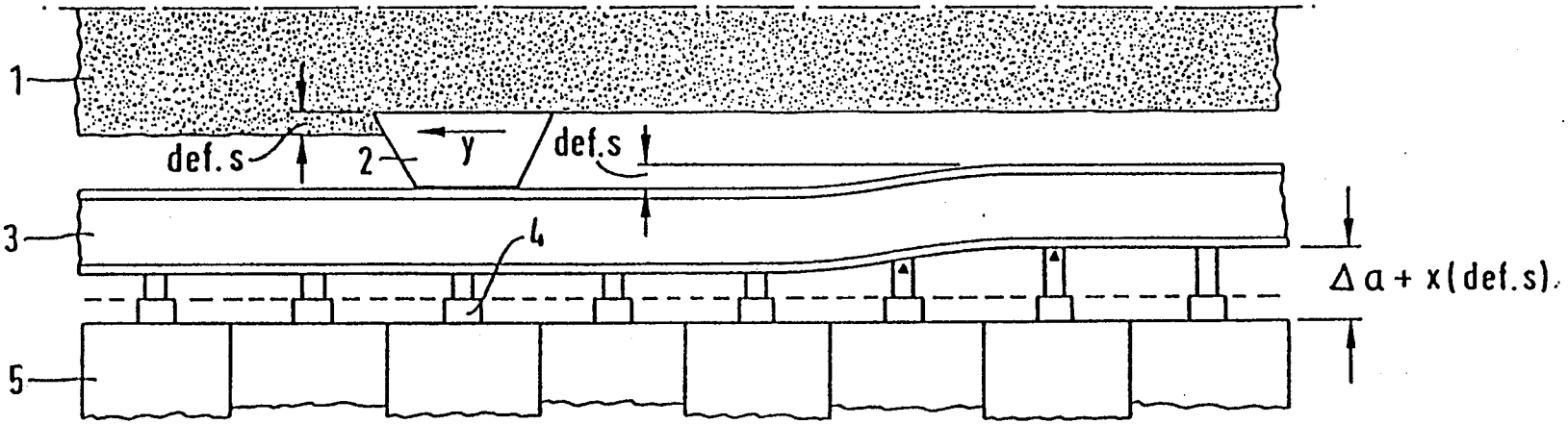
Figure 4:
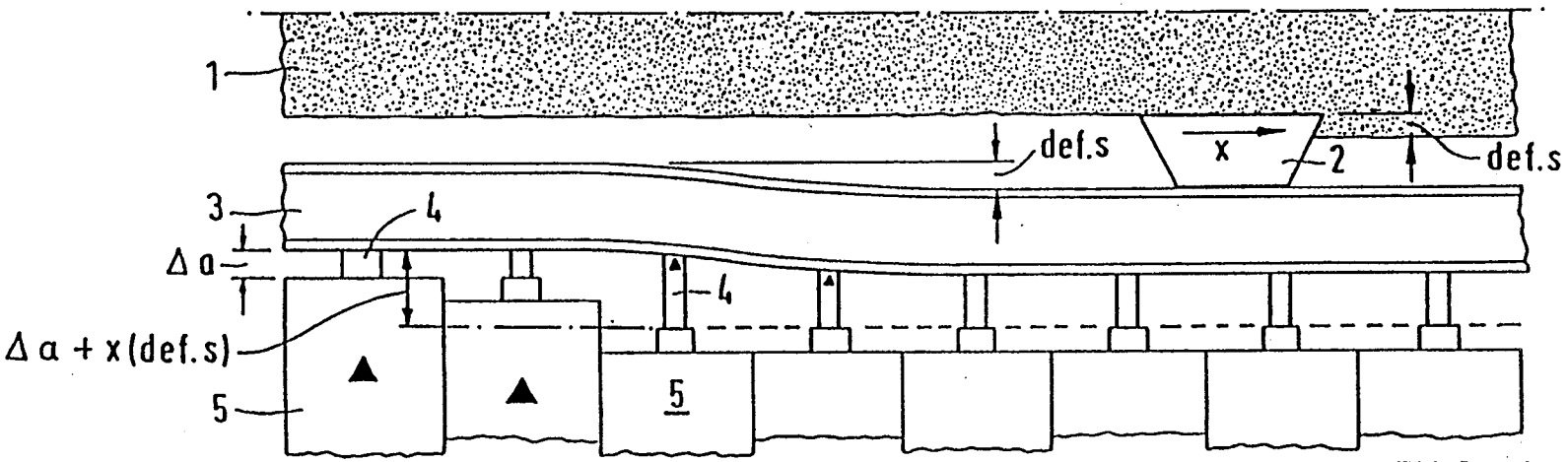

FIG. 3 shows phase 3 of the process in which the cutter reverses the direction of motion as per arrow y. As before, those self-advancing cylinders which have passed the cutter are now extended again by the defined preset depth of cutting plus an amount for compensating the clearance so that the cylinders are now extended by the amount 2 x (def.s)$+\Delta a$, starting from a first reversal of the cutter. After a predetermined maximum total piston stroke is reached, the roof support connected to the respective self-advancing cylinder is automatically retracted, moved forwards by the total maximum piston stroke, and then re-set (the self-advancing process). This process is shown in FIG. 4, in which the two roof supports at the left edge of FIG. 4 have already made or are making this advance. In addition, the self-advancing cylinders are controlled so that the sum of the partial strokes of the self-advancing cylinders in neighbouring roof supports is compared, and if two neighbouring roof supports simultaneously reach the maximum total stroke of the self-advancing cylinders, the two neighbouring supports are advanced in succession in a predetermined sequence (algorithm). In this manner the shield-type supports monitor themselves, thus ensuring that two neighbouring roof supports cannot advance simultaneously. Alternatively in principle, however, the first advance can be made by the roof support which first reaches the maximum stroke of its self-advancing cylinder. The sum of the partial strokes of the self-advancing cylinders in the roof supports is continuously measured and determined in a central computer unit so that, if a travel-measuring signal corresponding to a partial stroke of one or more cylinders is missing, a fault signal is generated and/or the cylinder for which no signal has been generated is shown on a display. This automatic check prevents a roof support remaining behind the other supports and thus preventing orderly advance of the conveyor.

Figure 5:
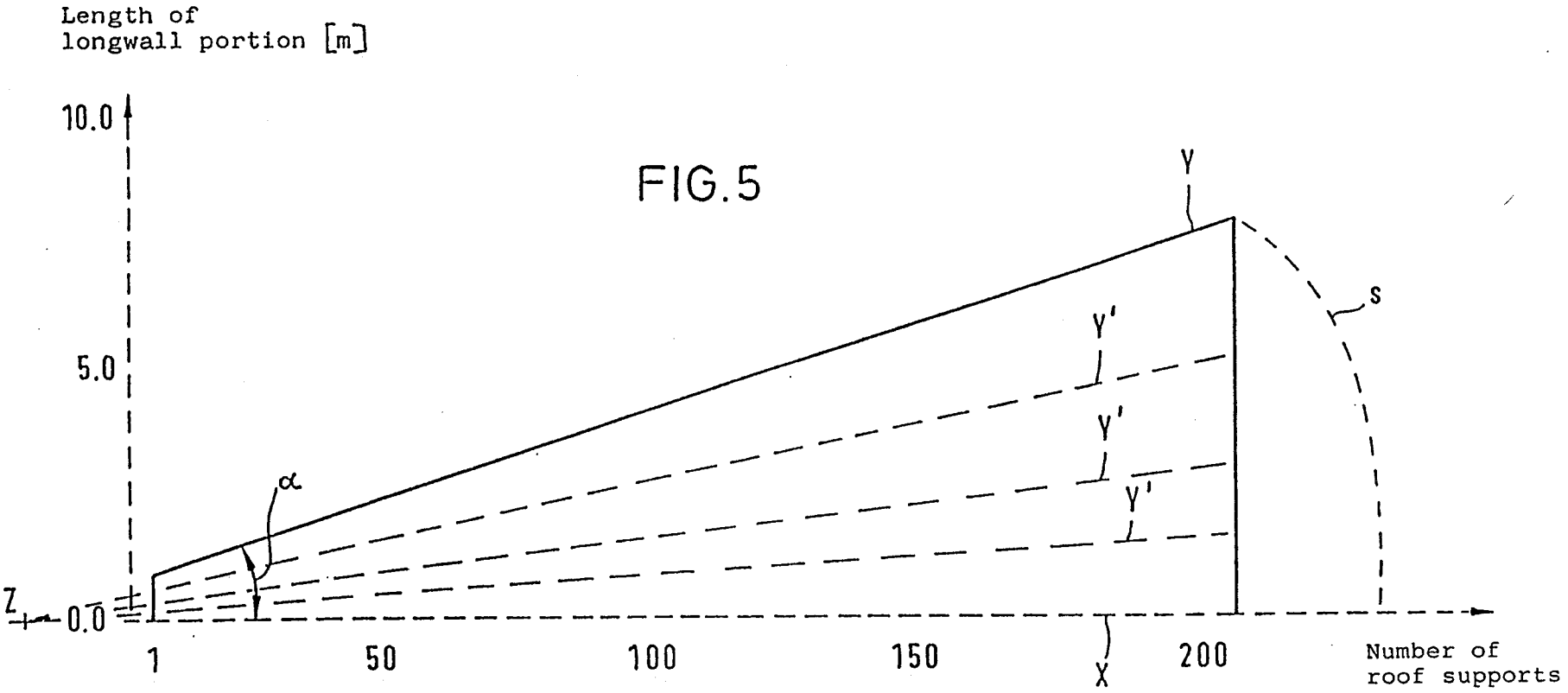
FIG. 5 is a diagrammatic sketch of a circular segment for mining by the method according to the invention.

FIG. 5 is a diagrammatic sketch of the longwall for mining a circular segment by the method according to the invention. In FIG. 5, a chain line X represents an initial face line, from which the face is to be pivoted. The line Y represents a face-line end value. Accordingly, a circular segment is formed between the two straight lines X and Y, lines X and Y running through a common centre of rotation which, in the embodiment shown, is on the side of the main drive of the cutter. This common centre is marked Z. In order to start the method of pivoting the longwall according to the invention, the following information is fed in:

Firstly, the direction of pivoting is fed in, i.e. pivoting to the left or to the right. When the preset direction of pivoting is to the left as in the example shown, the centre of rotation Z is on the side of the main drive. If pivoting occurs to the right, the centre Z is on the side of the auxiliary cutter drive. The desired pivoting angle $\alpha$, i.e. the angle between the lines X and Y, is also fed in. This angle is determined by the size of the arc s formed by the segment. The maximum size of the arc per pivoted segment is about 25 meters. The total pivoting angle, when a number of segments are successively mined, is not more than 180°. The bending of the conveyor, i.e. the maximum permitted bending of the individual conveyor components relative to one another, is also preset. The bending can be about 3°. The aforementioned values are now used to determine the advance during mining by the individual roof support, so that the individual supports are advanced at partial strokes $\Delta x$ which are equal but different from one support to another, each partial stroke corresponding to a given amount def.s per roof support. However, the partial strokes are limited on the one hand by the maximum and on the other hand by the minimum cutting depth of the cutter. The maximum cutting depth or the maximum partial stroke $\Delta x$ can be 50 mm and the minimum cutting depth or the minimum partial stroke can be 10 mm. The input and calculated values are saved so that they are available on the mainframe even after a voltage failure. After the segment for mining has been determined in this manner, the individual roof supports, depending on their distance from the centre of rotation, are moved forwards in individual equal partial strokes $\Delta x_1$–$\Delta x_n$ differing one one support to another until the respective face-line final value is reached, i.e. the line Y in the example shown, the cutter being continuously driven along the entire face. When the complete segment has been cut, only shadow cutting occurs, i.e. cutting without advancing the conveyor, and the control centre spontaneously reports that the final value has been reached.

In FIG. 5, chain lines Y′ denote intermediate positions reached by the individual roof supports during mining of the segment. After the total angle for the required complete pivot through 180° has been reached, the device automatically switches off and the operator is required to re-input the advance for mining the longwall. Starting, for example, with 160 roof supports, a minimum partial stroke $\Delta x = 10$ mm and a maximum partial stroke $\Delta x = 50$ mm and a maximum travel of 1000 mm at the 160th support and 20 mm at the 1st support, the following sequence of operations is obtained:

| Support Shield No. | No. of partial strokes | Size of partial stroke | Total travel |
|---|---|---|---|
| 160 | 20 | 50 mm | 1000 mm |
| 80 | 20 | 25 mm | 500 mm |
| 40 | 20 | 12.5 mm | 250 mm |
| 20 | 20 | 6.25 mm | 125 mm |
| 10 | 20 | 3.1 mm | 62.5 mm |
| 5 | 20 | 1.5 mm | 31 mm |
| 1 | 20 | 1 mm | 20 mm |

Since the partial stroke (6.25 mm) of shield 20 is less than the minimum partial stroke of 10 mm, shield 20 is moved forwards only every second time. Correspondingly, shields 10, 5 and 1 are moved forwards each third, seventh and tenth time respectively.

According to another preferred feature of the invention, the automatic sequence is blocked for the first 50 shields from the centre of rotation. These shields are brought up by hand after the set circular segment has been mined.

Figure 6:
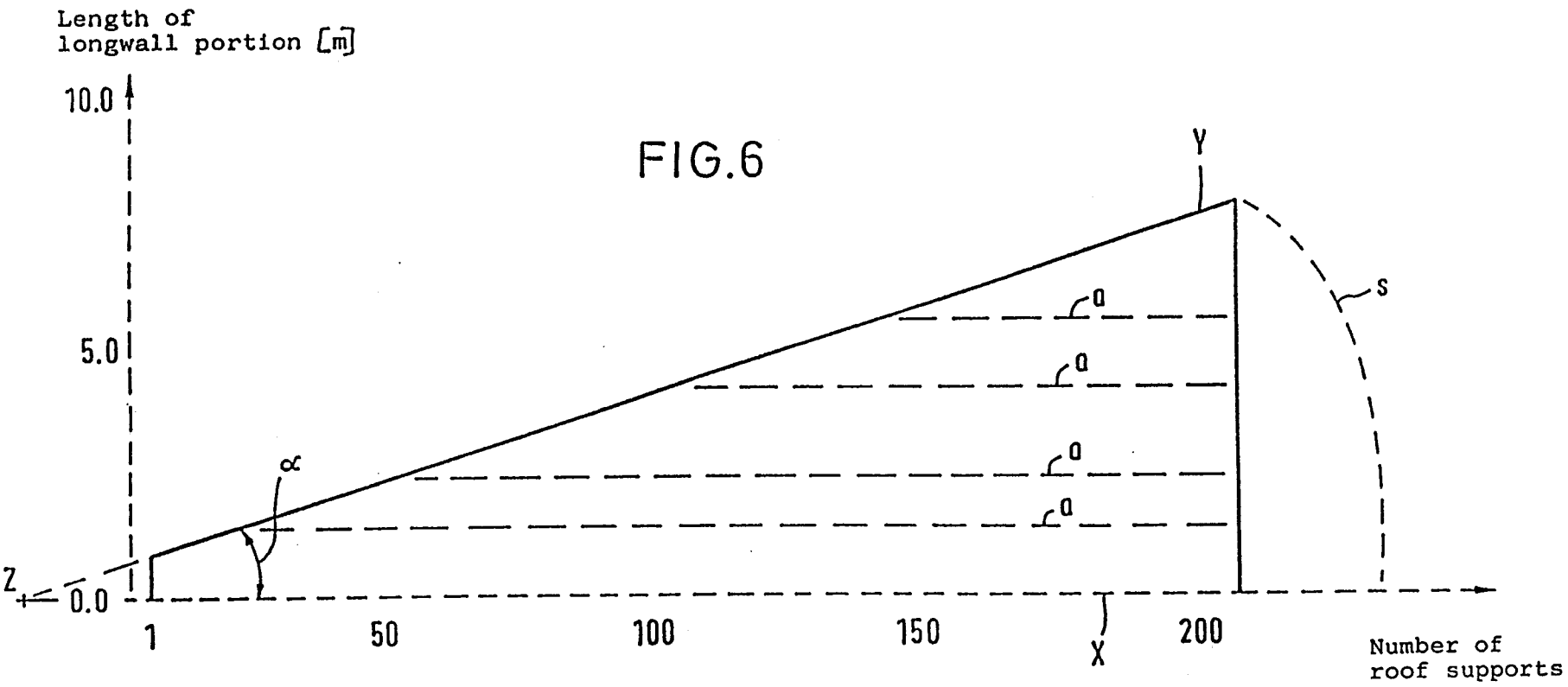
FIG. 6 is a diagrammatic sketch of a segment for mining by another method according to the invention.

FIG. 6 is a diagrammatic sketch of another method of pivoting the longwall according to the invention. In this case the preset values for the direction of pivoting, the angle of pivoting, the centre of rotation, the distance of the first shield from the centre of rotation, the bending of the conveyor and the desired arc are input as previously described. In contrast however to the method in FIG. 5, the advance of the conveyor or of the individual shield-type supports until reaching the face-line end value along line Y and starting from the initial value along line X is made in individual equal constant partial strokes corresponding to the desired preset depth of cutting def.s. In order to mine the desired segment, in the present case according to the invention the cutter travel a (shown in chain lines) is shortened along the face in dependence on the advance of the individual roof supports and the times when each face-line final value is reached.

To avoid duplicating the drive of the cutter at the place where the cutter reverses at the lateral drives, it may also be advantageous if the partial strokes in a presettable area in the neighbourhood of the lateral drives are twice as great as the partial strokes in the rest of the longwall.

I claim:

1. A method of mining coal seams at a defined preset depth of cutting during ploughing by a cutter, which method comprises positioning a longwall conveyor along a coal face, moving the longwall conveyor forwards through a defined preset cutting depth by extending self-advancing cylinders, pivoting the said cylinders at one end to the longwall conveyor and at the other end to roof supports disposed parallel to the longwall conveyor, controlling the advance of the longwall conveyor in dependence on a piston stroke of a respective self-advancing cylinder, making the advance in individual defined partial strokes using travel-measuring signals generated at each partial stroke, and, after a predetermined maximum total piston stroke has been reached, automatically retracting the roof support connected to the respective self-advancing cylinder, moving the said roof support forwards by the maximum total piston stroke, and then re-setting the roof support, increasing the distance covered by the partial strokes corresponding to the preset depth of cutting by an amount sufficient to compensate an average mechanical clearance at the pivot points of the self-advancing cylinders, fixing a defined face line inside the face in the form of a final value with respect to a centre of rotation on the side of a main or auxiliary drive of the cutter so that the final value forms a straight line through the centre of rotation, and pivoting the straight line through an angle $<90°$ with respect to the respective preceding initial face line which lies on a straight line likewise passing through the centre of rotation so that a circular segment is mined.

2. A method according to claim 1 which comprises moving the individual roof supports forwards by means of the conveyor, depending on their distance from the centre, in individual equal-sized partial strokes, different from one support another, until the respective face-line final value is reached, while continuously moving the cutter along the entire face.

3. A method according to claim 2 which comprises limiting the value of the individual partial strokes by the maximum and minimum cutting depth of the cutter.

4. A method according to claim 2 which comprises shadow cutting the coal seam after reaching the final value.

5. A method according to claim 2 which comprises blocking the automatic advance in the case of up to 50 first roof supports following the centre of rotation.

6. A method according to claim 1 which comprises advancing the individual roof supports by means of the conveyor in constant equal partial strokes, and shortening the distance travelled by the cutter along the face in dependence on the advance of the roof supports and the time when each reaches the face-line final value.

7. A method according to claim 1 which comprises saving, in each case, the values determining the segment.

8. A method according to claim 1 which comprises, in the region of the lateral drives, doubling the partial strokes over a set region with respect to the partial strokes in the rest of the longwall.

* * * * *